United States Patent [19]

Sasaki

[11] 4,358,938

[45] Nov. 16, 1982

[54] HAND KNITTING MACHINE

[75] Inventor: Kojiro Sasaki, Nagoya, Japan

[73] Assignee: Brother Kogyo Kabushiki Kaisha, Japan

[21] Appl. No.: 303,873

[22] Filed: Sep. 21, 1981

[30] Foreign Application Priority Data

Oct. 2, 1980 [JP] Japan ..... 55-138333

[51] Int. Cl.[3] ..... D04B 7/04; D04B 7/00

[52] U.S. Cl. ..... 66/64; 66/60 H

[58] Field of Search ..... 66/60, 60 H, 64, 70, 66/76, 67

[56] References Cited

U.S. PATENT DOCUMENTS 2,812,650 11/1957 Fischer ..... 66/60 H
3,412,582 11/1968 Kitazawa ..... 66/70
4,238,937 12/1980 Nakaoka ..... 66/60 H

FOREIGN PATENT DOCUMENTS 529661 7/1954 Belgium ..... 66/60 H
47-33746 8/1972 Japan ..... 66/64

*Primary Examiner*—Ronald Feldbaum
*Attorney, Agent, or Firm*—Leydig, Voit, Osann, Mayer & Holt, Ltd.

[57] ABSTRACT

A loop transfer device including a carriage supported by transverse sliding movement on first and second needle beds on each of which are disposed a multiplicity of latch needles is disclosed. A first path is formed on the carriage for guiding the butts of the loop transferring latch needles on the first needle bed therein and moving such latch needles in a direction perpendicular to the longitudinal direction of the first needle bed. A second path is formed on the carriage for guiding the butts of the loop receiving latch needles on the second needle bed therein and moving such latch needles in a direction perpendicular to the longitudinal direction of the second needle bed. Needle detent means is provided on the carriage for regulating the position of the forward portions of the latch needles in the second path and those of the latch needles in the first path relative to the longitudinal directions of the first and second needle beds when the hooks of the latch needles in the second path are engaged with the loops of yarn carried by the latch needles in the first path, whereby the hooks of loop receiving latch needles may be engaged accurately with the loops of yarn carried by the loop transfer latch needles so as to effect reliable loop transfer from the loop transfer latch needles to the loop receiving latch needles.

3 Claims, 19 Drawing Figures

HAND KNITTING MACHINE

BACKGROUND OF THE INVENTION

This invention relates to a hand knitting machine having a pair of needle beds each with a multiplicity of latch needles and, more particularly, to a device capable of transferring the loops of yarn carried by latch needles on a first needle bed to the corresponding latch needles on a second needle bed.

Conventionally, in the hand knitting machine of this kind, use has been made of a tool for transferring loops of yarn having a rod portion for engaging with the loops of yarn and an opening for engaging with the latch needle hooks, so that the loops of yarn carried by the latch needles on first needle bed may be sequentially transferred by manual operation onto the corresponding latch needles on the other needle bed. Such transfer of the loops of yarn from a number of latch needles for transferring the loops of yarn (hereinafter simply designated as a "transfer latch needle") to the corresponding latch needles for receiving the loops of yarn (hereinafter designated as a "receiving latch needles") has involved a great deal of working time and a laborious manual operation.

In order to eliminate such defect in the conventional art, there has been proposed a device for automtically transferring the loops of yarn including a loop transfer carriage mounted across first and second needle beds and capable of sliding in the direction of juxtaposition of the latch needles. The carriage has a first path for guiding the butts of the transfer latch needles on first needle beds therein and moving them in the fore and aft direction, and a second path for guiding the receiving latch needles on the second needle bed therein and moving them in the fore and aft direction.

In case of performing an operation of loop transfer in such conventional device, the first needle bed is moved longitudinally relative to the other so that the transfer latch needles on the first needle bed are displaced laterally relative to the receiving latch needles on the second neelde bed, by a predetermined distance less than the pitch of juxtaposition of the latch needles. In this way, the loops of yarn carried by the transfer latch needle are positioned inclinedly and with a predetermined gap relative to their corresponding loop receiving latch needles. In this state, the carriage is slid on the first and second needle beds so that, by the operation of said first path, the transfer latch needles are moved from a position back of the push behind latch ppsition to a position ahead of the push behind latch position and again to the position back of the push behind latch position and that, by operation of said second path, certain specific receiving latch needles are moved to a position wherein their hooks are engaged with said inclined loops of yarn and are then receded so as to pull the loops of yarn by their hooks. Thus, the loops of yarn carried by the transfer latch needles may thus be transferred to the receiving latch needles.

However, in the conventional device for transferring the loops of yarn, the transfer and receiving latch needles are wobbed laterally due to tension fluctuation acting on the loops of yarn during the transfer of loops of yarn and hence the hooks of the latch needles in the second path may not be intruded accurately into loops of yarn carried by the latch needlds in the first path, but deflected to the outside of the loops of yarn, thus the loops of yarn not being transferred from the transfer latch needles to the receiving latch needles. The loops of yarn may thus be disengaged from both the latch needles and the loops of yarn thus disengaged must be manually picked up from the narrow gap between the two needle beds and then, be engaged on the receiving latch needles, which is truly a laborious operation.

SUMMARY OF THE INVENTION

This invention has been made to obviate such drawback inherent in the conventional art and has it as an object to provide an improved loop transfer device in a hand knitting machine..whereby the transfer of loop of yarn may be performed reliably.

According to a preferred embodiment of the invention, in order to attain such object, needle detent means is provided on the loop transfer carriage for regulating the transverse positions of the latch needles. When at least the hooks of the latch needles disposed in the second path are engaged with sliding of the loop transfer carriage into the loops of yarn carried by the latch needles in the first path, the two latch needles are engaged at the forward portions thereof with said needle detent means and are thereby regulated and held in the corresponding predetermined lateral positions. Hence the loops of yarn carried by the receiving latch needles may be accurately engaged with the loops of yarn carried on the transfer latch needles so as to effect the positive transfer of the loops of yarn from the transfer latch needles to the receiving latch needles.

BRIEF DESCRIPTION OF THE DRAWINGS

FIGS. 5A*b*, 5C*b*, 5F*b* and 5J*b* are partial perspective views corresponding to FIGS. 5A*a*, 5C*a*, 5F*a* and 5J*a*, respectively.

DESCRIPTION OF THE PREFERRED EMBODIMENT

Figure 1:
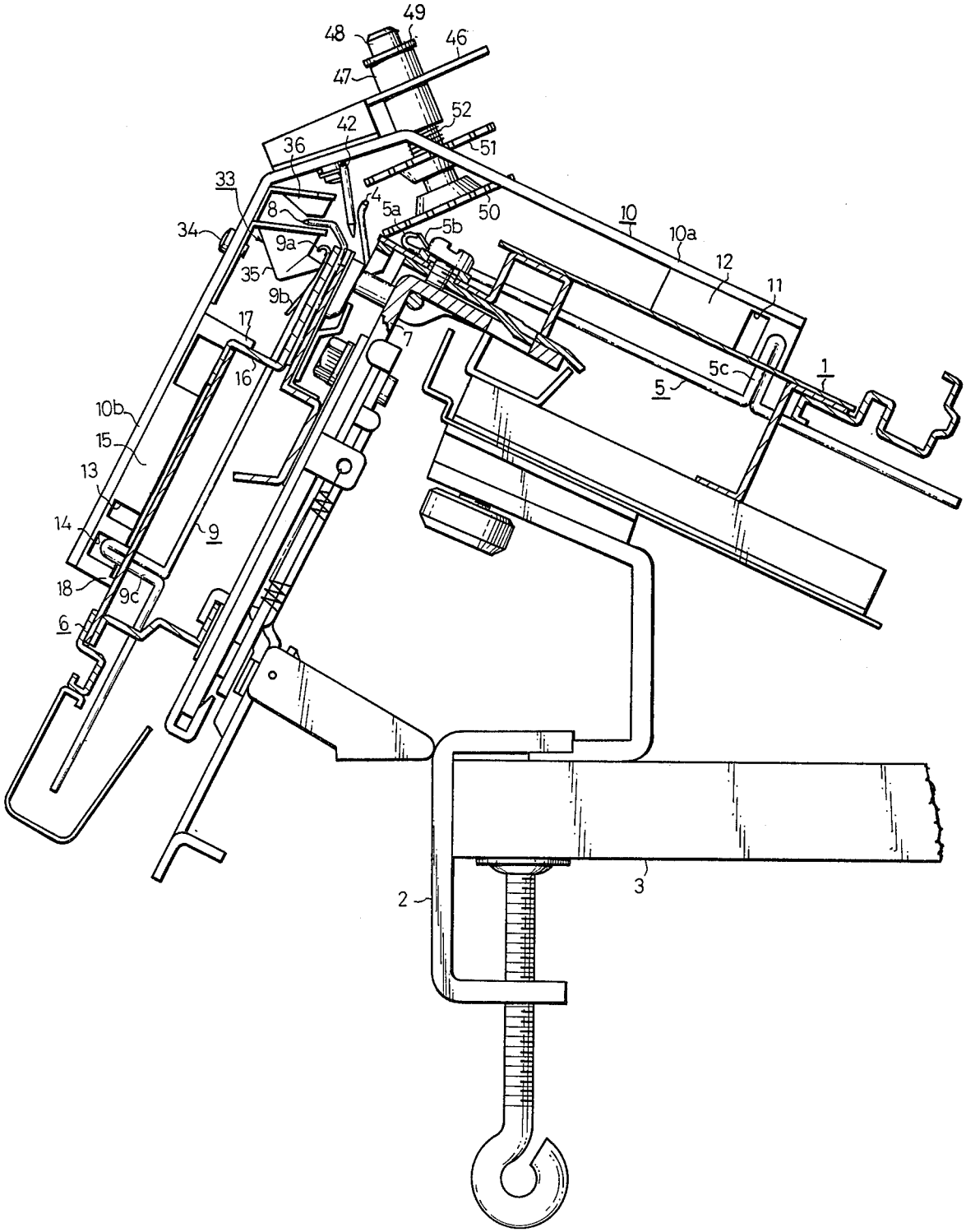
FIG. 1 is a side elevation of the hand knitting machine embodying the present invention.

Referring to the drawings shown an embodiment of the the present invention, a main needle bed (second needle bed) 1, designed to make ordinary stitches, chiefly plain stitches, is secured by clamps 2 to a table 3, and has a multiplicity of upstanding wire-like stationary sinkers 4 at fixed intervals along the forward edge of the needle bed. A multipicity of latch needles 5, each consisting of a hook 5*a*, a latch 5*b* and a butt 5*c* are arranged for sliding separately in the fore and aft direction, with each latch needle being disposed between two neighboring sinkers 4. A sub needle bed (first needle bed) 6, designed to make rib stitches through cooperation with said main needle bed 1, is mounted at an angle of about 90 degrees to the front lower side of the main needle bed 1 by means of a holder 7. A multiplicity of upstanding wire-like sinkers 8 are secured to the upper edge of the sub needle bed at the same intervals as those for the sinkers 4 on the main needle bed 1, and a multiplicity of latch needles 9, each consisting of a hook 9*a*, a latch 9*b* and a butt 9*c*, are separately arranged for vertical movement, with each latch needle 9 being disposed between ajoining two sinkers 8.

The sub needle bed 6 is made to be movable between the upper use position or rib stitch enable position as shown in FIG. 1 and the lower non-use position or rib stitch disable position sufficiently lowered from said use or rib stitch enable position. While said sub needle bed 6 is in said use position, it is also movable between a position facing to each loop receiving latch neelde 5 on the main needle bed 1 and a position to be vertically displaced from such facing relation.

A carriage 10 for transferring loops of yarn is mounted on said main needle bed 1 and said sub needle bed 6 for sliding in the direction of juxtaposition of the latch needles 5 and 9. To the lower surface of a portion 10*a* in the carriage 10 corresponding to the main needle bed 1, there is secured a first cam member 12 constituting a guide path (second path) 11 for introducing into and guiding the butts 5*c* of the latch needles 5 on the main needle bed 1, the lower surface of said cam member 12 being in sliding contact with the upper surface of the main needle bed 1. To the bottom surface of a portion 10*b* in the carriage 10 corresponding to the sub needle bed 6, there is secured a second cam member 15 constituting a lead path (first path) 13 for introducing and guiding the butt 9*c* of the latch needle 9 carrying a transferring loop K of yarn on the sub needle bed 6 and a rest path 14 for introducing and guiding the butts of the remaining needles 9. The second cam member 15 has at the upper edge thereof an upper sliding portion 17 being in sliding contact with an upper guide portion 16 of the sub needle bed 6, and at the lower edge a lower sliding portion 18 being in sliding contact with the front side of the sub needle bed 6.

Figure 2:
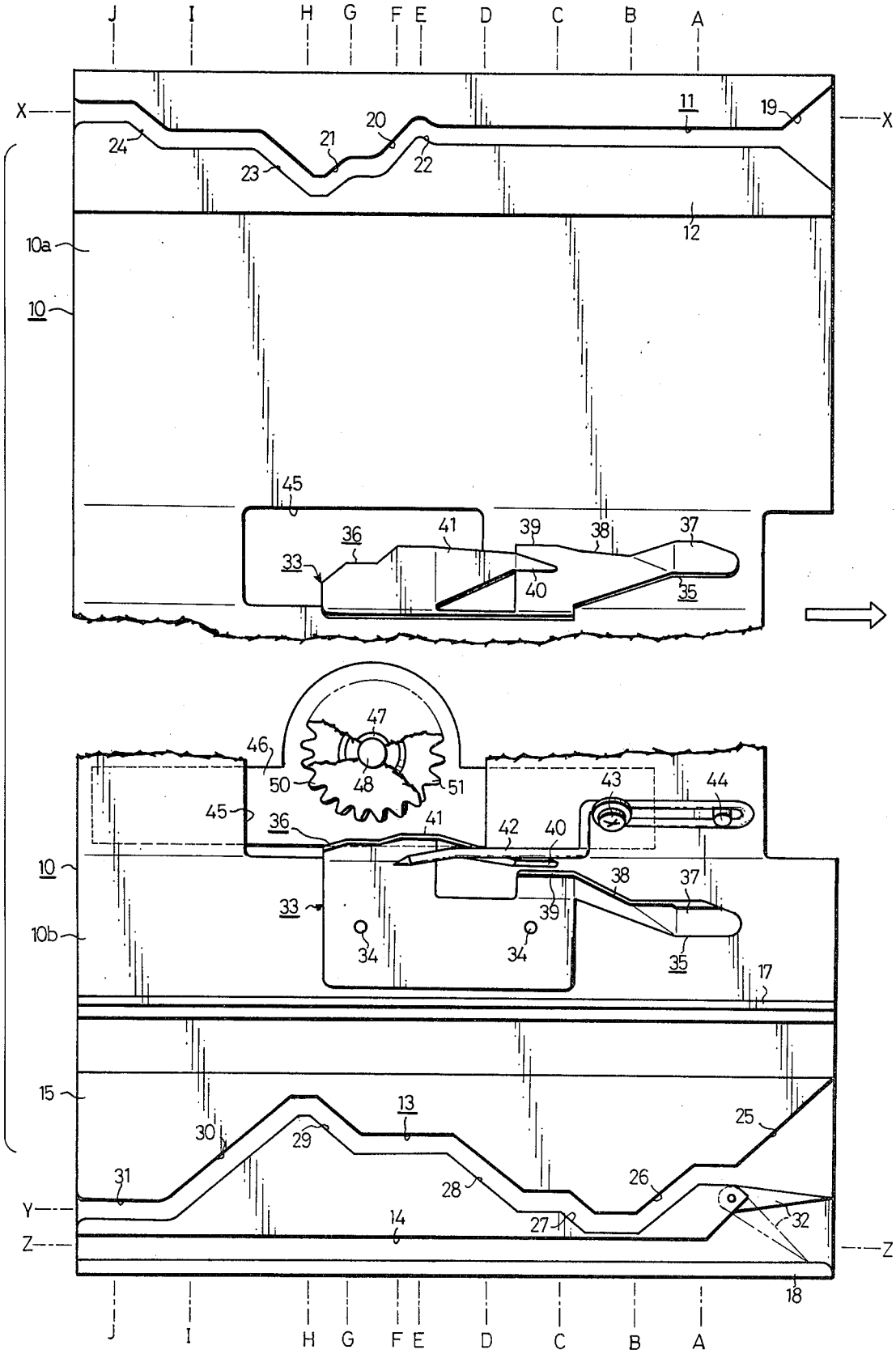
FIG. 2 is a partially omitted bottom view showing a loop transfer carriage shown in FIG. 1, wherein the carriage is shown as being severed at the center and developed for showing the upper and lower parts thereof.

As shown in FIG. 2, the guide path 11 is formed with a guide cam portion 19 substantially in the form of a funnel, a rear lifting cam portion 20 for advancing the. latch needles 5 on the main needle bed 1 so that their hooks 5*a* are advanced from back to ahead of the line of juxtaposition of the sinkers 4, a front lifting cam portion 21 for further slightly advancing the latch needles 5 thus advanced by said rear lifting cam portion 20, a front lowering cam portion 22 for slightly receding the latch needles 5 immediately being acted on by said cam 20, a middle lowering cam portion 23 adapted for receding the latch needles 5, advanced by said front lifting cam portion 21, to a position such that their hooks 5*a* are positioned substantially in register with the line of juxtaposition of said sinkers 4, and a rear lowering cam portion 24 for further receding the latch needles 5 to a standard position X such that their hooks 5*a* are located at the back of the line of juxtaposition of the sinkers 4, the latch needles 5 being then led out in said position X.

Said lead path 13 is formed with a substantially funnel-shaped guide cam portion 25, a first lowering cam portion 26 for receding the latch needles 9 on the sub needle bed 6, as guided by said guide cam portion 25, from the position substantially immediately preceding the push behind latch position (the position wherein the hook 9*a* is projected above sinker 8 and the loop K of yarn is cast over the opened latch 9*b*) to a position substantially in register with the line of juxtaposition of the sinkers 8, a first lifting cam portion 27 for slightly advancing the latch needles 9 receded by said cam portion 26, a second lifting cam portion 28 for further advancing the latch needles 9 to a position immediately preceding the push behind latch position, a third lifting cam portion 29 for further advancing the latch needles 9 to a position ahead of the push behind latch position, and a second lowering cam portion 30 for receding the needles 9, which have passed through the third lifting cam portion 29, from a position ahead of the push behind latch position to a position back of said push behind latch position.

The exit portion of the lead path 13 contiguous to said cam portion 30 is formed with a guide portion 31 proximate to cast off position so that the butt 9*c* of the latch needle 9, being receded by said cam portion 30 away from the position preceding to the push behind latch position and towards back of such push behind latch position, is halted at a position Y proximate to cast off position (that is, the position slightly ahead of the standard position Z being in the same state as the standard position X for the latch needles 5 on the main needle bed 1 wherein the hook 9*a* on the needle 9 is projected slightly above the line of juxtaposition of the sinkers 8), the butt 9*c* being led out while being at such position Y. At the entrance portion to the lead path 13, there is mounted a switch cam 32 to be alternatively switched between two positions for making the following arrangement.

The arrangement is so made that, when the switch cam 32 is positioned as shown by the solid line in FIG. 2, it operates to guide only the butts 9*c* of those latch needles 9 on the sub needle bed 6 that have been slightly advanced beyond the standard position Z, into the lead path 13, and to guide the butts 9*c* of latch needles 9 that remain in the standard position Z, into rest path 14, and that, when the switch cam 32 is shifted to the chain line position in FIG. 2, it operates to guide the butts 9*c* of all latch needles 9 ahead of the standard position into the lead path 13.

A latch control member 33 is secured to the lower surface of the carriage 10 by a pair of screw 34 and, as shown in FIG. 1, has a lower control piece 35 positioned below the line of juxtaposition of the sinkers 8 and an upper control piece 36 positioned above the line of juxtaposition of the sinkers 8. As will be described later, the member 33 operates during transfer of the loop of yarn to continuously obstruct the latch 9*b* of latch needles 9 on the sub needle bed 6 from being levelled down towards the rear, for a certain fixed time interval, so as to push out the loop K of yarn carried by the hook 9*a* of the needle 9.

As shown in FIG. 2, the lower control piece 35 of the latch contron member 33 is formed with a catching portion 37 designed to catch the end of the opened and levelled latch 9*b* when the needle 9 on the sub needle bed 6 has been receded by the first lowering cam portion 26, an inclined surface 38 designed to raise the latch 9*b* caught by the catching portion 37, and a first pressing portion 39 designed to level down and press the latch 9*b*, raised by the inclined surface towards the hook 9*a*, for projecting the end of the latch 9*b* above the sinkers 8. The upper control piece 36 of the latch control member 33 is formed with a second pressing portion 40 designed to take over the operation of the first pressing portion 39 so as to continue to press the latch 9*b* of latch needle 9, and a raising surface 41 by means of which the latch 9*b* of the latch needle 9 acted upon by the pressing portion 40 is kept in the raised position.

In the vicinity of the latch control member 33 and a presser bar 42 is secured by a screw 43 and a pin 44 at the base end thereof to the lower surface of the carriage 10 for depressing the already formed loops of yarn during loop transfer as will be described later. The carriage 10 has an opening 45 substantially in the middle through which is projected the hook 9*a* of the latch needle 9 on the sub needle bed 6.

As shown in FIGS. 1, 2, 5E, 5F and 5G, an attaching plate 46 is secured to the upper surface of the carriage 10 above the opening 45 and a bearing sleeve 47 is fixedly passed through substantially the middle of the attaching plate 46. An axis 48 is fitted rotatably and axially movably into said bearing sleeve 47, and is held against accidental removal by a stop ring 49. To the lower end of the axis 48, there are secured a pair of gear wheels (needle detent means) 50 and 51 that are used as latch needle position regulating members and provided with a number of teeth 50*a* and 51*a* on the peripheries thereof, said gear wheels 50 and 51 being spaced apart a predetermined distance from each other and being urged normally downwards along with said axis 48 by operation of a pressure spring 52.

Figure 3:
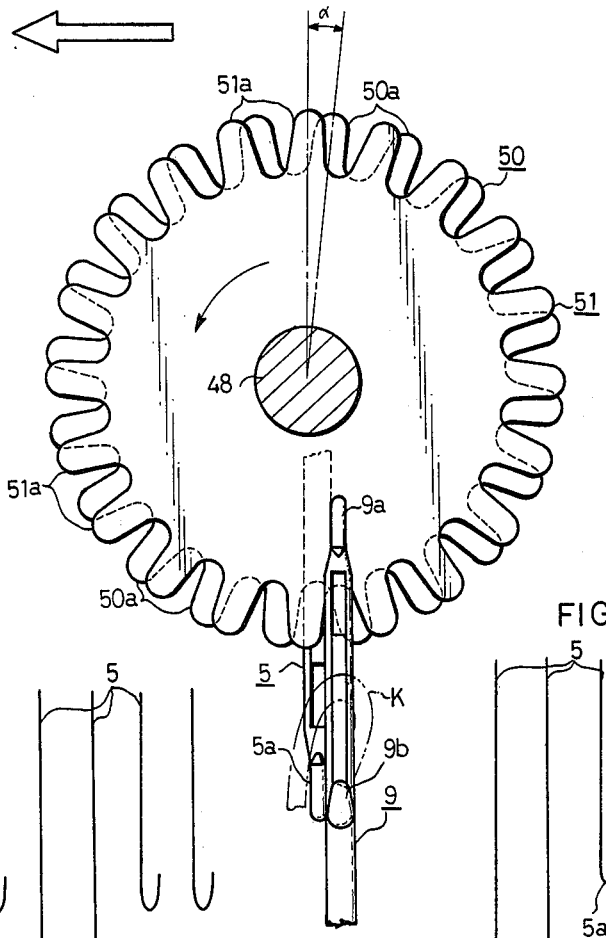
FIG. 3 is an enlarged sectional plan view showing the gear wheels as regulating members and the latch needles being in the course of loop transfer operation.

As shown in FIG. 3, the teeth 50*a* of the lower gear wheel 50 are displaced relative to the teeth 51*a* of the upper gear wheel 51 clockwise by an angular measure $\alpha$ which is slightly less than one half the pitch of juxtaposition of the latch needles. The arrangement is so made that, during transfer of the loops of yarn to be later described, when the hook 5*a* of latch needle 5 in the guide path 11 projects into the loop K of yarn of the latch needle 9 in the lead path 13, the tooth 50*a* of the lower gear wheel 50 engages with the forward portion of the latch needle 5 to receive said forward portion in the tooth gullet, whereas the tooth 51*a* of the upper gear wheel 51 engages with the forward portion of the other latch needle 9 to receive said forward portion in the tooth gullet, the forward portions of the latch needles 5 and 9 being thereby regulated to predetermined transverse mutual position.

Although not shown, a pair of knitting carriage for making rib stitches in a known manner are mounted on the needle beds 1 and 6 for sliding transversely, that is, in the left and right direction. Plain stitches etc. can be made by using only the carriage associated with the main needle bed 1.

The loop transfer device for the dual bed type hand knitting machine, as described in the above, operates as follows.

Figure 4A:
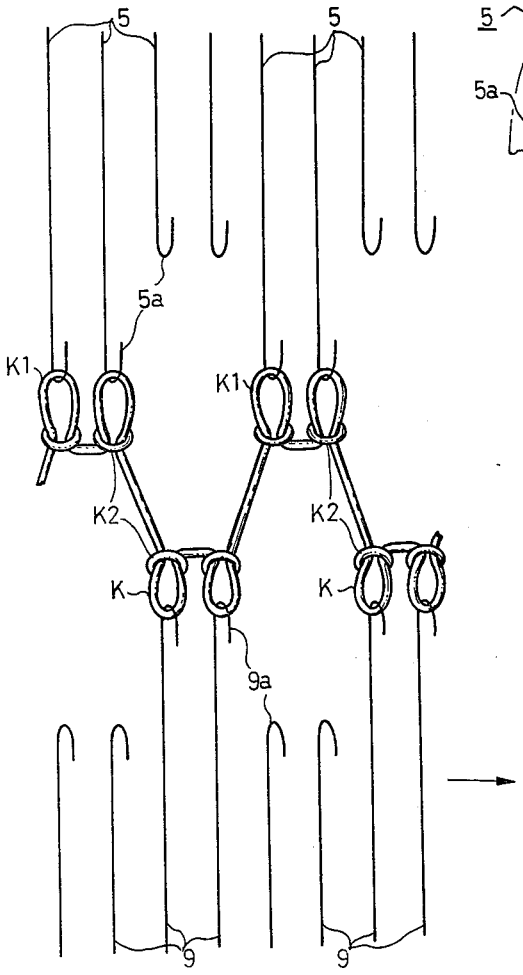
FIGS. 4*a* and 4*b* are partial developed front views showing the state of the loop of yarn prior to the transfer of loop of yarn.

In this dual bed type hand knitting machine, as shown in FIG. 4*a*, the latch needles 5 on the main needle bed 1 and the latch needles 9 on the sub needle bed 6 are placed in a confronting relation to each other. Alternate two groups of the latch needles 5 and 9 in the working or knitting zone cooperate to perform so called dual stitch rib knitting by using the said pair of knitting carriages. In the course of knitting, when shifting to e.g. plain knitting wherein only the main needle bed 1 and the knitting carriage associated therewith are used, the loops K of yarn carried by the latch needles 9 of the sub needle bed 6 are transferred, in advance of such plain knitting, to the latch needles 5 of the main needle bed 1 by use of the carriage 10 designed for transfer of the loop of yarn.

Figure 4B:
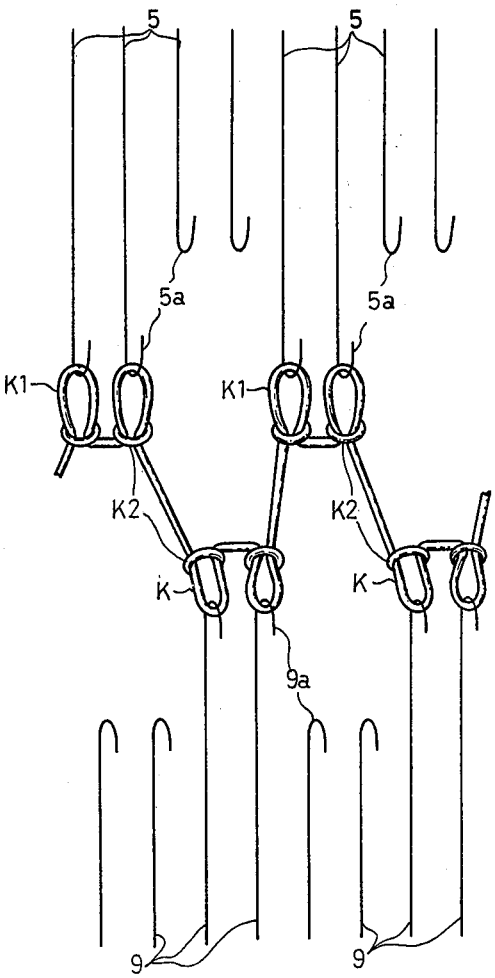

Referring more particularly to this loop transfer operation, the sub needle bed 6 is moved towards right transversely relative to the main needle bed 1 by a distance slightly smaller than one half pitch of juxtaposition of the latch needles, and is fixed at such position. Thus, as shown in FIG. 4*b*, each of left hand side loops K of yarn carried by alternate needles 9 on the sub needle bed 6 is inclined towards right relative to a loop K2 of yarn of the next lower course, and is positioned in front of one of the latch needles 5 displaced towards left by a distance less than one half pitch relative to the latch needles 9 on the sub needle bed 6.

Then, alternate two latch needles 5 in the working zone not carrying the loop K1 of yarn on the main needle bed 1 are advanced from the rear rest position to near the standard position Z shown in FIG. 2, while the latch needles 9 on the sub needle bed 6 carrying said inclined loop K of yarn are advanced to a position slightly ahead of the standard position Z, the switch cam 32 on the lower surface of the carriage 10 being switched to the solid-line position in FIG. 2. It is to be noted that, during this first transfer of the loop of yarn, only the respective specific latch needles 5 (hereinafter designated as "first receiving latch needles") on the main needle bed 1 corresponding to the latch needles 9 carrying the inclined loops K of yarn may be advanced to the standard position X, the remaining respective latch needles 5 (hereinafter dsignated as "second reciving latch needles") not carrying the loops K1 of yarn being advanced to the standard position X during the second transfer of the loop of yarn, as later described.

Figure 5A:
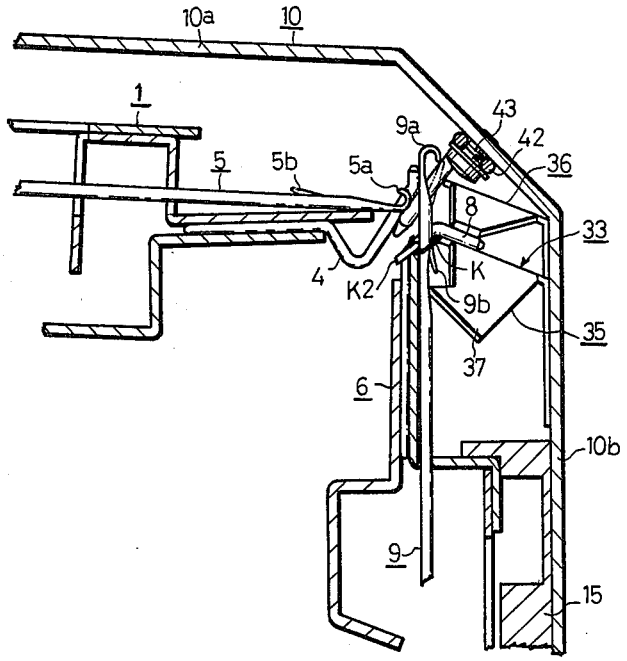
FIGS. 5A*a*, 5B, 5C*c*, 5D, 5E, 5F*a*, 5G, 5H, 5I and 5J*a* are partial sectional views of the hand knitting machine and showing the consecutive operating states in the course of the loop transfer operation.
Figure 5A:
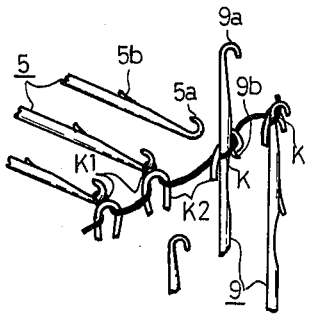

The carriage 10 is then moved from right towards left relative to the group of the latch needles of the knitting zone, the butts 5*c* of the respective latch needles 5 on the main needle bed 1 within such knitting zone are guided sequentially into the guide path 11 from the standard position X, while butts 9*c* of the respective latch needles 9 (hereinafter designated as "second transfer latch needles") on the sub needle bed 6 carrying the inclined loops K of yarn are sequentially guided by the switch cam 32 into the second path 13, and butts 9*c* of the respective latch needles 9 (hereinafter designated as "second transfer latch needles") carrying the uninclined loops K of yarn are guided into the rest path 14 while being in the standard position Z. Thus the states shown in FIGS. 5A*a* and 5A*b* are reached when the first receiving latch needle 5 and the first transfer latch needle 9 have reached the position A in FIG. 2.

Figure 5B:
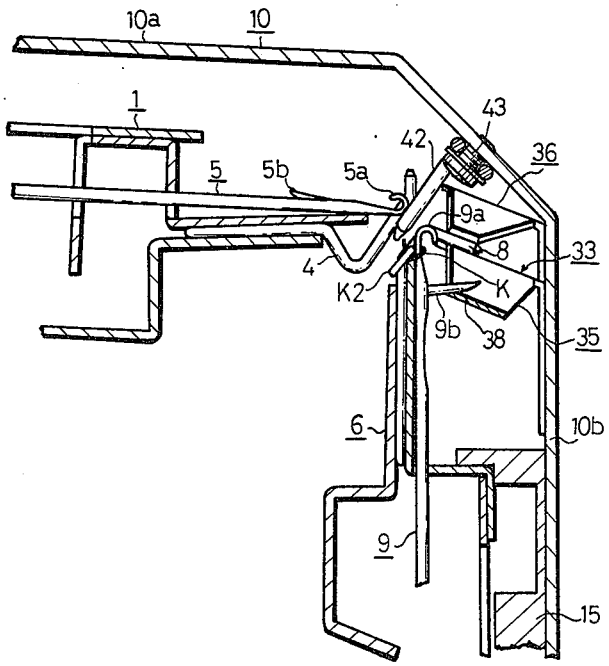

When the latch needles 5, 9 have reached the position B in FIG. 2, by continued sliding of the carriage 10, the first transfer latch needles 9 are receded by the first lowering cam portion 26 as shown in FIG. 5B, the latch 9*b* in the opened levelled condition is caught by the catching portion 37 of the latch control member 33 and raised by the inclined surface 38. The first receiving latch needles 5 are not affected at this time. The second transfer needles 9 on the sub needle bed 6 are also not affected and are guided along the rest path 14 while being in the standard position Z.

Figure 5C:
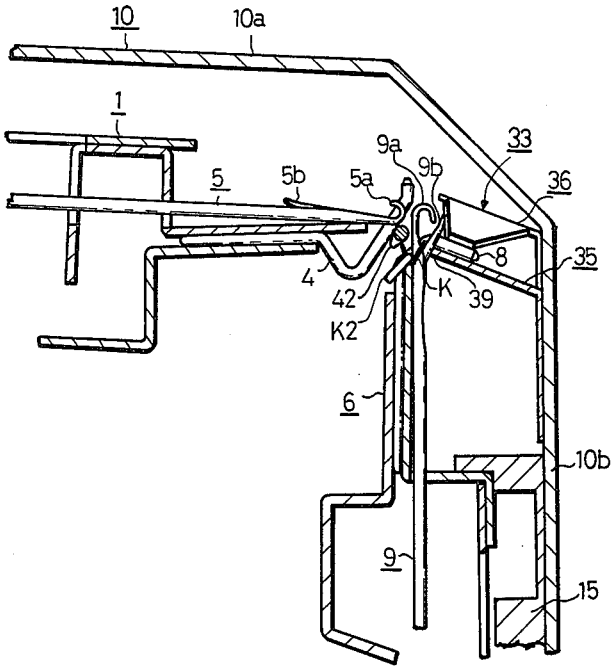
Figure 5C:
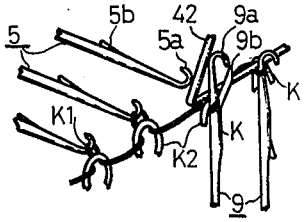
Figure 5D:
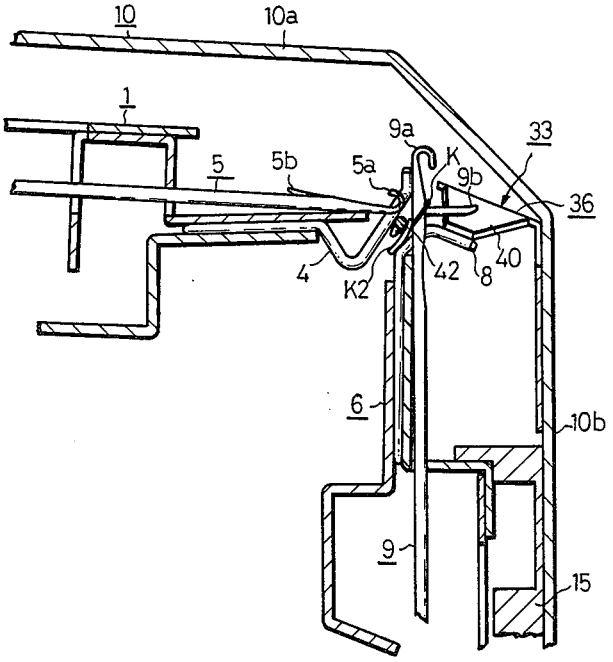

When the needle 5, 9 have reached the position C in FIG. 2, by continued sliding of said carriage 10, the first transfer latch needles 9 are advanced slightly by the first lifting cam portion 27, as shown in FIGS. 5C*a* and 5C*b*, the latches 9*b* thereof being held in the levelled position against the hooks 9*a* by the first pressing portion 39. The lower base portions of the loops K of yarn carried by the first transfer latch needles 9 are pressed by the presser bar 42, while the first receiving latch needles 5 still not affected.

Then, when the latch needles 5, 9 arrive at position D in FIG. 2, the first transfer latch needles 9 are advanced by the second lifting cam portion 28, with the latches 9*b* thereof being raised by the second pressing portion 40 and the raising surface 41 and held in the raised position. The loops K of yarn carried by the hooks 9*a* of first transfer latch needles 9 are gradually moved upwards. The first transfer latch needle 5 are not affected at this time.

Figure 5E:
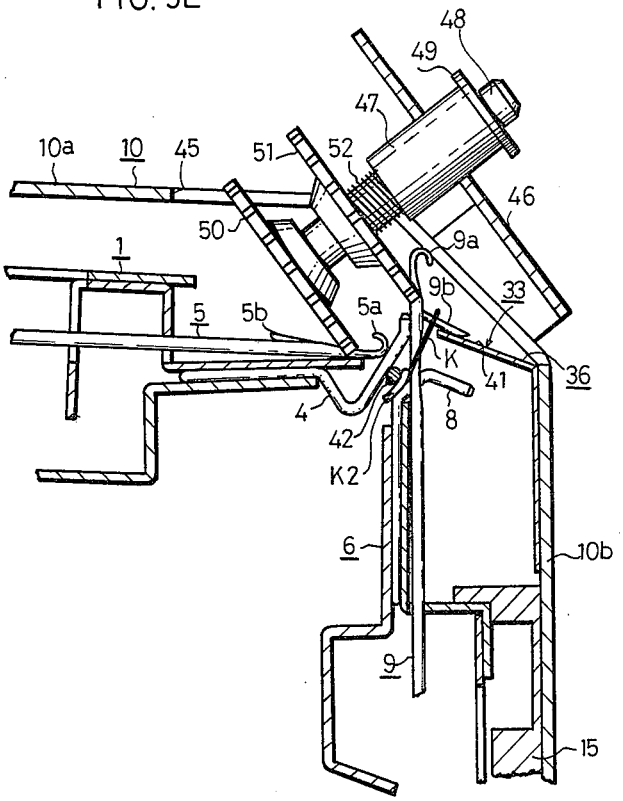
Figure 5F:
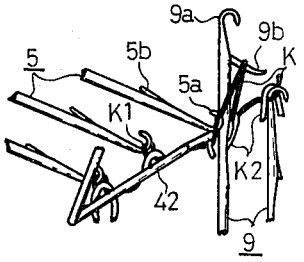
Figure 5F:
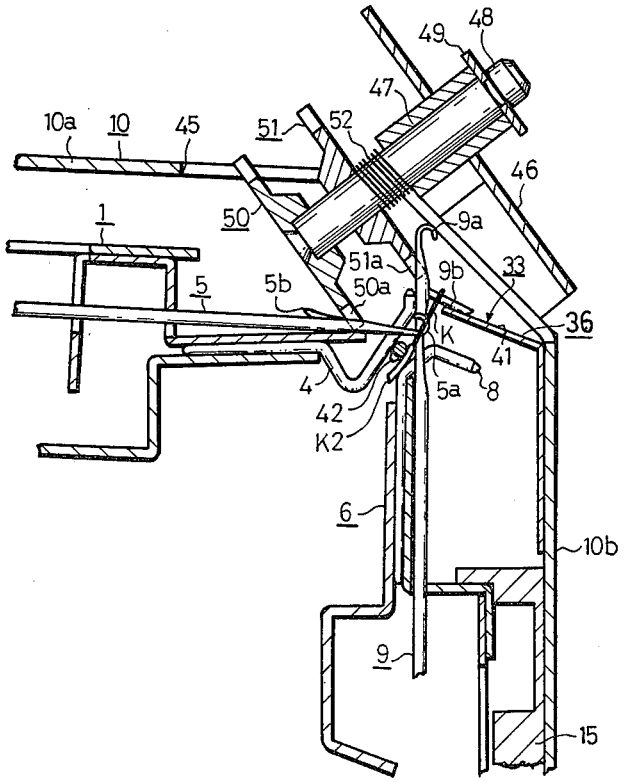

When the latch needles 5, 9 arrive at position E in FIG. 2, with sliding of carriage 10, the first transfer latch needles 9 are further advanced by the second lifting cam portion 28, as shown in FIG. 5E and the latches 9*b* are held in the raised position by the raising surface 41. Thus the loops K of yarn are further advanced and enlarged, the hooks 5*a* of the first receiving latch needles 5 corresponding to such loops of yarn at this time, the preceding latch needles 5 next to the first receiving latch needles 5 on the main needle bed 1 are receded slightly by the front lowering cam portion 22, and the loops K1 of yarn carried by the latch needle 5 are slightly receded towards the rear, so that tension is applied to the loops K of yarn on the first transfer latch needles 9 contiguous to the loops K1 of yarn.

When the latch needles 5, 9 arrive at the position F in FIG. 2, with continued sliding of the carriage 10, the first transfer latch needles 9 are maintained in the same state as at position E, while the first receiving latch needles 5 are advanced rather abruptly by the rear lifting cam portion 20. At this time, the teeth 50*a* of lower gear wheel 50 are engaged with the forward portion of the first receiving latch needles 5, while the teeth 51*a* of the upper gear wheel 51 are engaged with the forward portions of the first transfer latch needles 9, so that the forward portions of the latch needles 5, 9 are regulated to a predetermined transverse position relative to each other. Thus the latch needles 5, 9 may be free from wobbling and the hooks 5*a* of the first transfer latch needles 5 may be introduced easily and accurately into the enlarged and tensioned loops K of yarn.

In the present embodiment, since the gear wheels 50, 51 are supported by the bearing sleeve 47 of the mounting plate 46 via said axis 48 for rotation and axial movement, and are urged to move downwards by operation of the pressure spring 52, should the forward portions of the first receiving latch needles 5 be engaged inadequately, that is, not with the tooth gullets but with the top surfaces of the teeth 50*a*, the gear wheel 50 is moved up immediately along with said axis 48, against the action of the pressure spring 52, thus an overdue force being not applied to the latch needles 5 or to the gear wheel 50 to prevent any damage to these components from occurring. With further sliding of the carriage 10, the gear wheel 50 is immediate-returned to the lower position under the action of the pressure spring 52 and the tooth thereof is engaged normally with the latch needles 5. When the upper gear wheel 51 is inadequately engaged with the first transfer latch needle 9, the latch needle 9 will escape forwardly against its own resiliency and be normally immediately engaged with the teeth 51*a* of gear wheel 51 with sliding of the carriage 10.

Figure 5G:
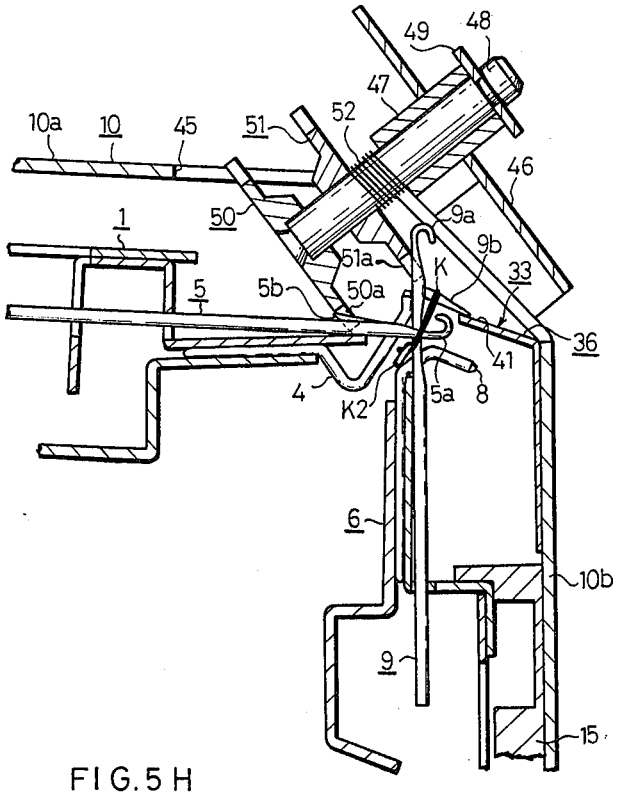

When the latch needles 5, 9 arrive at the position G in FIG. 2, with sliding of the carriage 10, the first receiving latch needles 5 are further advanced by the rear lifting cam portion 20 and their hooks 5*a* are fully introduced into the loops K of yarn, with the forward portions of the latch needles 5, 9 being regulated continuously to a predetermined mutual transverse position brought about by engagement between teeth 50*a*, 51*a* of the gear wheels 50, 51 as shown in FIG. 5G. Furthermore, at this time, the pressure bar 42 ceases to be operative.

Figure 5H:
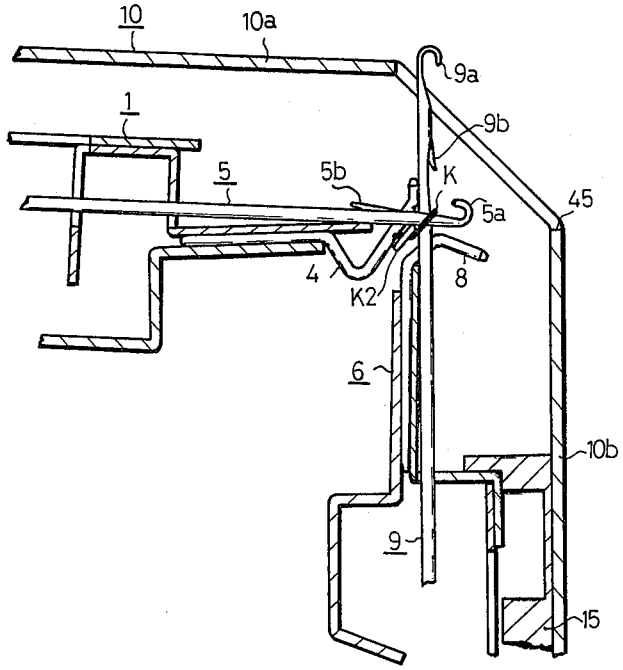

When the latch needles 5, 9 arrive at the position H in FIG. 2 with continued sliding of the carriage 10, the first transfer latch needles 9 are advanced by the third lifting cam portion 29, as shown in FIG. 5H and their latches 9*b* are disengaged from the surface 41 of the latch control member 33, the loops K of yarn being moved from the hook portions onto needle stem portions. At this point, the first receiving latch needles 5 are slightly advanced by the front lifting cam portion 21.

Figure 5I:
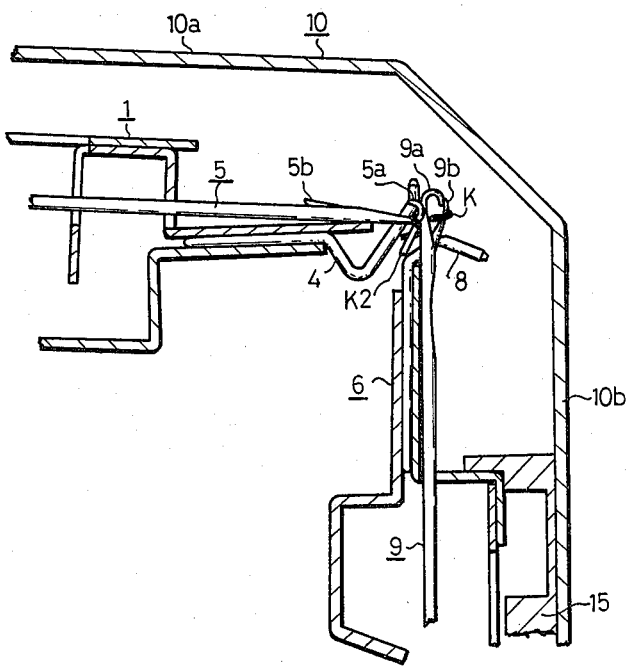

When the latch needles 5, 9 arrive at the position I in FIG. 2 with sliding of carriage 10, the first transfer latch needles 9 are receded by the second lowering cam portion 30, as shown in FIG. 5I, the first receiving latch needles 5 being receded by the middle lowering cam portion 23. Thus, the loops K of yarn, carried by the latch needles 5, 9, are positioned on the latches 9*b* closed on the hooks 9*a* on the side of the first transfer latch needles 9 and within the hooks 5*a* on the side of the first receiving latch needle 5.

Figure 5J:
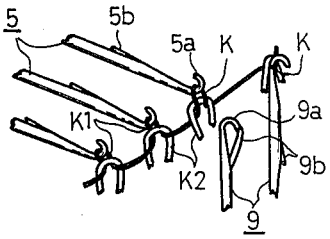
Figure 5J:
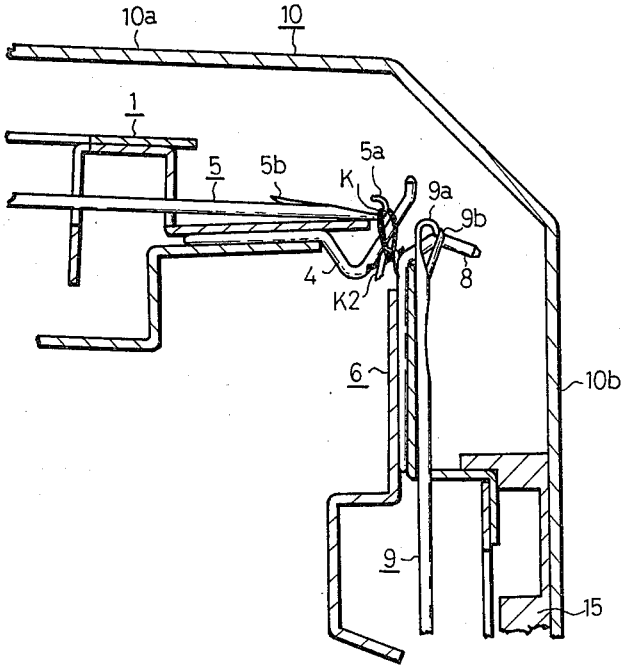

When the latch needles 5, 9 arrive at the position J in FIG. 2 with sliding of carriage 10, the first transfer latch needles 9 are fully receded to the position proximate to cast off position Y, by the second lowering cam portion 30, the loops K of yarn remaining on the latches 9*b* that are closed on the hooks 9*a*. On the other hand, since the first receiving latch needles 5 are receded at this time by the rear lowering cam portion 24 to the standard position X, and the loops K of yarn are pulled by the hooks 5*a* thereof to back of the associated sinkers 4, the loops K of yarn are forcedly cast off, as shown in FIGS. 5J*a* and 5J*b*, from the position on the closed latches 9*b* of the first transfer latch needles 9 and onto the hooks 5*a* of the first receiving latch needles 5.

In this way, the loops K of yarn on the respective first transfer latch needles 9 are transferred sequentially onto hooks 5*a* of the respective first receiving latch needles 5 associated therewith to complete the first loop transfer operation. At this time, the loops K of yarn carried by hooks 9*a* of the second transfer latch needles 9 on the sub needle bed 6 are inclined towards right relative to the loops K2 of yarn of the next lower course and are positioned ahead of and in register with second receiving latch needles 5 on the main needle bed 1.

If, during such first transfer of the loops of yarn, the hooks 5*a* of the first receiving latch needles 5 are not intruded by some reason into the loops K of yarn of the first transfer latch needles 9, but are deffected away from the loops K of yarn, the loops K of yarn are not transferred onto the hooks 5*a* of the first receiving latch needles 5, thus giving rise to the so-called stitch drop. If stitch drop should occur, the dropped loops K of yarn must be manually picked up from the narrow gap between the beds 1 and 6 by laborious operation.

In the present embodiment, the guide portion 31 proximate to cast off position is provided to the outlet portion of the lead path 13, as shown in FIG. 2 for ultimately regulating the recede movement of the first transfer latch needles 9 at the position Y proximate to cast off position, so that said loops K of yarn will remain on the closed latches 9*b* of the first transfer latch needles 9 without disengaging from their hooks 9*a*. Thus the laborious operation of picking up the dropped loops K of yarn is dispensed with and it is only necessary to get the loops K of yarn on the closed latches 9b of the first transfer latch needles 9 transferred to the hooks 5a of the first receiving latch needles 5 by means of a latch needle tool or the like.

Referring to the second loop transfer operation, the respective first transfer latch needles 9 on the sub needle bed 6, from which the loops of yarn have been transferred, are receded from said position Y proximate to cast off position to the rear resting position, and the switch cam 32 on the lower surface of the carriage 10 is switched to the chain-line position in FIG. 2. It is to be noted that said first transfer latch needles 9 may remain at the position Y proximate to cast off position in order to effect the second loop transfer operation.

When the carriage 10 is again slid from right to left and relative to the group of latch needles of the working zone, the buts 5c of the respective latch needles 5 including the second receiving latch needles 5 on the main needle bed 1 are guided sequentially from standard position X into the guide path, while butts 9c of the second transfer latch needle 9 carrying the inclined loops K on the sub needle bed 6 are guided sequentially from standard position Z into the lead path 13 by means of switch cam 32. Through cooperation among the latch control member 33 and the respective cams in the two paths 11, 13, the second receiving latch needles 5 and the second transfer latch needles 9 are actuated as at the first loop transfer operation to sequentially transfer the loops K of yarn of the respective second transfer latch needles 9 onto hooks 5a of the respective second receiving latch needles 5 to complete the second loop transfer operation.

In this way, once the loops K of the yarn carried by the latch needles 9 on the sub needle bed 6 have all been transferred to the latch needles 5 on the main needle bed 1, by the sliding operations of the carriage 10, the sub needle bed 6 is brought to a non-use position in which rib knitting is not feasible, and the main needle bed may then be used together with the carriage annexed thereto for performing plain stitch work or the like.

When it is desired to shift again to rib stitch work from plain stitch work, the sub needle bed 6 may be brought to an upper use position, at the same time that the loops K1 of yarn that are carried by the latch needles 5 on main needle bed 1 each spaced apart by an adequate number of latch needles 5, are transferred by a transfer tool onto hooks 9a of the corresponding latch needles 9 on the sub needle bed 6. Rib knitting may then be performed by using the two carriages.

Although the foregoing description of the loop transfer operation has been made with reference to the case of so-called dual stitch rib knitting, such transfer operation may be performed in the case of so-called single stich rib knitting wherein every two latch needles 5 and 9 placed in confronting realtion to each other are participated in knitting, or in the case of whole rib knitting wherein all the latch needles 5, 9 of the working zone that are displaced in advance by a distance equal to one half pitch of juxtaposition of the latch needles are used for knitting.

Thus, in the case of single stitch rib knitting, the sub needle bed 6 is shifted laterally relative to main needle bed 1 towards right by a distance less than one half pitch of juxtaposition of latch needles, and secured at this position, as at the time of the dual stitch rib knitting described above. By having the carriage 10 slid once from right hand side towards left hand side of the working zone, the loops K of yarn carried by the latch needles 9 on the sub needle bed 6 may be transferred to the hooks 5a of the latch needles 5 on the main needle bed 1. In the case of the whole rib knitting, the sub needle bed 6 is shifted laterally relative to the main needle bed 1 towards right by a distance about equal to the pitch of juxtaposition of the latch needles, and there fixed, whilst the carriage 10 is slid once in this state towards left. In this way, the loops K of yarn carried by the latch needles 9 on the sub needle bed 6 may be transferred to the hooks 5a of the latch needles 5 on the main needle bed 1, similarly to the case of dual stitch rib knitting described above.

During transfer of the loops of yarn, since the transfer latch needles 9 are caused ultimately to remain at the position Y proximate to cast off position by the guide portion 31 proximate to cast off position, the loops K of yarn may occasionally remain on the closed latches 9b of the transfer latch needles 9 in case of large transferring loops K of yarn or small recede stroke of the receiving latch needles 5. In this case, the loops K of yarn can be casted off completely by compulsorily lowering the transfer latch needle 9 to the cast off position either by hand or by a pattern plate.

The present invention is not limited to the specific embodiments described above, but a number of modifications may be made of the component parts. For example, the latch control member 33 in the above embodiment may be replaced by a latch control brush whereby the latches 9b of the transfer latch needles 9 on the sub needle bed 6 may be actuated or held in a certain predetermined condition, or the needle position regulating means may be constituted by members other than gear wheels.

What is claimed is:

1. A hand knitting machine comprizing, first and second needle beds arranged at the predetermined positions relative to each other, a plurality of first latch needles aligned slidably on said first needle bed, a plurality of second latch needles aligned slidably on said second needle bed, a carriage mounted slidably on said first and second needle beds in the longitudinal direction thereof, a first path located at an underportion corresponding to said first needle bed, said first path guiding butts of said first latch needles which carry loops of yarn to be transferred to said second latch needles so as to move said first latch needles in the direction perpendicular to the longitudinal direction of said first needle bed, a second path located at an underportion of said carriage corresponding to the second needle bed, said second path guiding butts of said second latch needles which receive said loops of yarn transferred from the first latch needles so as to move said second latch needles in the direction perpendicular to the longitudinal direction of said second needle bed, whereby hooks of second latch needles engage with said loops of yarn, and needle detent means mounted on said carriage for regulating the position of forward portions of the first and second latch needles in said first and second paths to the longitudinal direction of said needle beds when the hooks of the second latch needles engage with the loops of yarn on the first latch needles.

2. A hand knitting machine as claimed in claim 1, wherein said needle detent means is a pair of rotatable gear wheels with teeth, each of said teeth respectively engaging with forward part of each of said first and second needles.

3. A hand knitting machine as claimed in claim 2, wherein said pair of gear wheels are secured to an axis on said carriage for the rotation thereabout.

* * * * *